United States Patent [19]

Crowe

[11] Patent Number: 4,712,384

[45] Date of Patent: Dec. 15, 1987

[54] INTEGRATED EVAPORATOR AND THERMAL EXPANSION VALVE ASSEMBLY

[75] Inventor: Lawrence E. Crowe, Lindenwood, Ill.

[73] Assignee: Sundstrand Corporation, Rockford, Ill.

[21] Appl. No.: 909,856

[22] Filed: Sep. 22, 1986

[51] Int. Cl.[4] ..... F25B 41/04

[52] U.S. Cl. ..... 62/225; 62/527; 165/40; 236/92 B

[58] Field of Search ..... 236/92 B; 62/225, 527, 62/528; 251/144; 165/40

[56] References Cited

U.S. PATENT DOCUMENTS

| | | | |
|---|---|---|---|
| 1,681,254 | 8/1928 | Otto et al. . | |
| 1,813,486 | 7/1931 | Eggleston . | |
| 1,890,247 | 12/1932 | Dieterich | 251/144 X |
| 2,003,915 | 6/1935 | Willoughby et al. | 251/144 X |
| 2,068,007 | 1/1937 | Dick . | |
| 2,190,723 | 2/1940 | McBride | 251/144 X |
| 2,257,212 | 9/1941 | Willoughby | 251/144 X |
| 2,532,019 | 11/1950 | Goldberg . | |
| 2,762,209 | 9/1956 | Bennett . | |
| 3,030,782 | 4/1962 | Karmazin . | |
| 3,570,263 | 3/1971 | Tobias . | |
| 4,114,397 | 9/1978 | Tokahashi et al. . | |
| 4,149,390 | 4/1979 | Iijima et al. . | |
| 4,589,265 | 5/1986 | Nozawa | 62/527 X |

*Primary Examiner*—William E. Tapolcai

*Attorney, Agent, or Firm*—Wood, Dalton, Phillips, Mason & Rowe

[57] ABSTRACT

An integrated evaporator and thermal expansion valve assembly for use in a refrigeration system. An evaporator includes a housing defining an inlet header and an outlet header. A valve is mounted on the housing in communication with the inlet header for controlling the flow of refrigerant to the evaporator of the refrigeration system. A pressure and temperature resonsive sensing bulb assembly is mounted on the housing in communication with the outlet header for responding to the superheat temperature in the outlet header of the evaporator for opening the valve when the superheat temperature increases and for responding to the pressure in the refrigeration system for closing the valve when the pressure increases to offset a portion of the effect of the temperature response on the valve. A coupling extends through the evaporator housing between the inlet and outlet headers for operatively interconnecting the pressure and temperature responsive bulb assembly to the valve as a function of the responses of the pressure and temperature responsive bulb assembly.

24 Claims, 5 Drawing Figures

INTEGRATED EVAPORATOR AND THERMAL EXPANSION VALVE ASSEMBLY

FIELD OF THE INVENTION

This invention generally relates to evaporators used with refrigeration systems and, particularly, to an integrated evaporator and thermal expansion valve assembly for use in a refrigeration system.

BACKGROUND OF THE INVENTION AND DESCRIPTION OF THE PRIOR ART

In conventional refrigeration or cooling systems, an expansion valve is installed and functions to expand and meter the flow of refrigerant into the evaporator heat exchangers and cold plates, and to maintain appropriate superheat conditions at the compressor's first-stage inlet. Heretofore, expansion valves most prominently have been installed in piping leading to the evaporator, usually separate from the evaporator assembly. This results in the evaporator and the expansion valve occupying a considerably large space. Such an expansion valve also is subject to vibrations and jolts, particularly when used in vehicular applications. Torque produced by the weight of the expansion valve acts on connections between the piping and the valve and between the piping and the evaporator, thereby causing breakage of the joints and leaking of the refrigerant. The evaporator's own weight itself acts on the connections between the piping and the expansion valve and also may cause breakage and resulting leakage.

Evaporator and expansion valve arrangements or systems as described above are used primarily in commercial applications and, often, in automotive applications, but such systems are not readily applicable for use in densely packaged envelopes typical of aircraft vapor cycle systems. Problems in terms of weight, space, plumbing or piping complexity, and reliability are encountered when such evaporator and valve systems are utilized in aircraft applications.

A typical commercial evaporator and expansion valve system is shown in U.S. Pat. No. 3,570,263 to Tobias, dated Mar. 16, 1971. A system such as the Tobias system includes a remote temperature sensing bulb and an equalizer line in addition to the other plumbing or piping connections described above. Such a system obviously would create packaging or envelope problems in densely packed envelopes typical of aircraft vapor cycle systems. In addition, the small capillary tube which connects the remote sensing bulb to the evaporator head is prone to breakage, particularly in high vibration environments.

Attempts have been made to solve the above problems as shown in the disclosures of U.S. Pat. Nos. 4,114,397 to Takahashi et al, dated Sept. 19, 1978, and 4,149,390 to Iijima et al, dated Apr. 17, 1979. In both of these patents, the thermal expansion valve is incorporated in an assembly of plates located at one end of a tube/fin evaporator construction. Although the systems shown in these patents eliminate much of the piping and the connections of commercial installations, they simply incorporate the valve as a mounting at one end of the evaporator and do not take advantage of the evaporator itself for comprising integral components of the thermal expansion valve assembly.

This invention is directed to solving many if not all of the above problems by incorporating a thermal expansion valve as an integral assembly with the evaporator itself, whereby portions of the evaporator comprise portions of the thermal expansion valve in an integrated system or assembly.

SUMMARY OF THE INVENTION

An object, therefore, of the invention is to provide a new and improved integrated evaporator and thermal expansion valve assembly for use in a cooling or refrigeration system or the like.

In the exemplary embodiment of the invention, the integrated assembly generally includes evaporator means having a housing defining an inlet header and an outlet header. Heat exchanger core means of the plate/fin type extend between the inlet and outlet headers. Valve means are mounted on the housing in communication with the inlet header for controlling the flow of refrigerant to the evaporator of the refrigeration system. Pressure and temperature responsive means are mounted on the housing in communication with the outlet header, for responding to the superheat temperature of the outlet header of the evaporator for opening the valve means when the superheat temperature increases, and for responding to the pressure in the refrigeration system for closing the valve means when the pressure increases to offset a portion of the effect of the temperature responsive means on the valve means. Coupling means extend through the evaporator housing between the inlet and outlet headers for operatively connecting the pressure and temperature responsive means to the valve means to move the valve means as a function of the responses of the pressure and temperature responsive means.

In the preferred embodiment of the invention, the evaporator housing has an opening to the inlet header and an opening to the outlet header. The valve means forms part of a unitary refrigerant inlet and valve assembly mounted in the opening to the inlet header integral with the evaporator housing. The pressure and temperature responsive means are mounted in the opening to the outlet header integral with the housing.

The valve means include a valve member backed by an adjustable superheat spring and movable toward and away from a valve seat; the pressure and temperature responsive means include a sensing bulb; and the coupling means operatively interconnects the sensing bulb and the valve member. The sensing bulb is secured to a diaphragm of a pressurized chamber and form part of a unitary sensing bulb assembly mounted in the opening in the evaporator housing in communication with the outlet header.

The coupling means include a push rod disposed within a surrounding enclosure tube extending through the heat exchanger core of the evaporator, the push rod interconnecting the sensing bulb of the pressure and temperature responsive means and the valve member of the valve means. The push rod may be fabricated of a material the same as that of the heat exchanger core to maintain a given superheat spring setting throughout the operating temperature range of the evaporator. Alternatively, the push rod may be fabricated of a material with a thermal coefficient of expansion different from that of the heat exchanger core to automatically trim the spring setting as the evaporator temperature varies.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
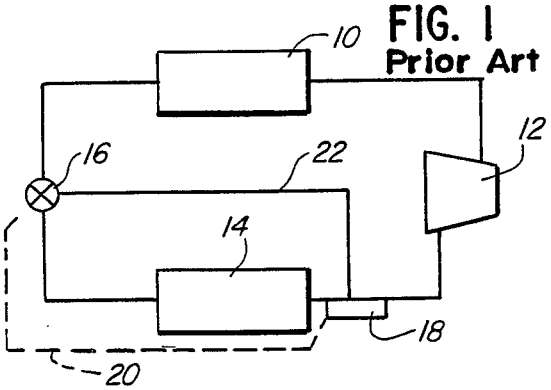
FIG. 1 Prior Art
FIG. 1 is a schematic illustration of a conventional commercial refrigeration system incorporating an evaporator and a thermal expansion valve.
Figure 2:
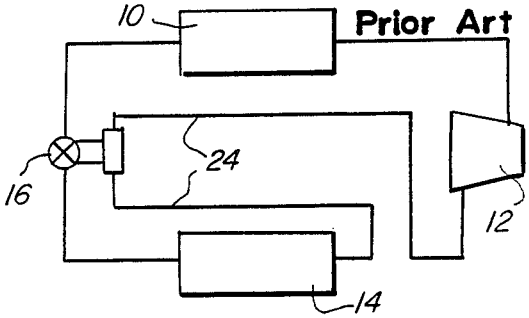
FIG. 2 Prior Art
FIG. 2 is a schematic illustration of a conventional automotive "block type" refrigeration system incorporating an evaporator and thermal expansion valve.

Referring to the drawings in greater detail, and first to FIGS. 1 and 2, thermal expansion valves heretofore have been manufactured for appropriate use in commercial and some automotive applications but which are not readily applicable for use in the densely packaged envelopes typical of aircraft vapor cycle systems. Problems in terms of weight, space, plumbing or piping complexity, and reliability are encountered when such systems are used in aircraft applications as contemplated by the present invention.

More particularly, FIG. 1 schematically illustrates a typical commercial-type thermal expansion valve system or installation. The system includes a condensor 10, a compressor 12, an evaporator 14 and a thermal expansion valve 16 serially connected as shown. The housings of commercial thermal expansion valves typically are constructed of brass and steel to allow assembly and installation into the refrigeration system by torch brazing, resulting in a relatively heavy assembly. In addition, a remote temperature sensing bulb 18 is connected between the outlet side of evaporator 14 and thermal expansion valve 16 by means of a capillary tube 20. An equalizer line 22 also is connected between the outlet side of evaporator 14 and thermal expansion valve 16. It immediately can be seen that this type of evaporator and thermal expansion valve installation or system has many connections between complex piping and can cause breakage problems, in addition to the fact that the system is not applicable for densely packed envelopes typical of aircraft vapor cycle systems. Furthermore, the small capillary tube which connects the remote sensing bulb 18 to the thermal expansion valve is prone to breakage, particular in high vibration environments. An example of this type of system is shown in the aforementioned U.S. Pat. No. 3,570,263.

FIG. 2 schematically illustrates a conventional automotive "block-type" thermal expansion valve system and, again, includes condenser 10, compressor 12, evaporator 14 and thermal expansion valve 16. Although this system eliminates the remote sensing bulb and equalizer line of commercial systems, a suction line 24 typically is routed through the body of thermal expansion valve 16 to accomplish the sensing and equalizing functions. Not only is the tubing complexity of such a system increased over the commercial system, but suction line pressure losses must be minimized to achieve optimal thermal performance. This usually requires relatively short, large internal diameter tubing thereby limiting flexibility in location of the thermal expansion valve and routing of the tubing, all of which is quite contrary to the goal of densely packaged envelopes for aircraft applications.

Figure 3:
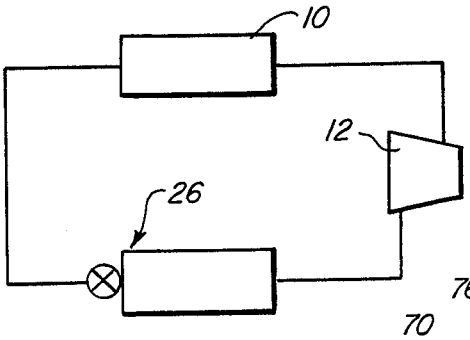
FIG. 3 is a schematic illustration of the integrated evaporator and thermal expansion valve assembly of the invention.

FIG. 3 schematically illustrates the system of this invention wherein an integrated evaporator and thermal expansion valve assembly, generally designated 26, is very simply serially connected between condenser 10 and compressor 12. The density advantages of such a small envelope is readily apparent, particularly when it can be seen how much of the piping/tubing and connections of prior installations are eliminated. In addition, it will be seen hereinafter how the integrated concept of this invention utilizes the evaporator itself to functional advantages in operation of the thermal expansion valve.

Figure 4:
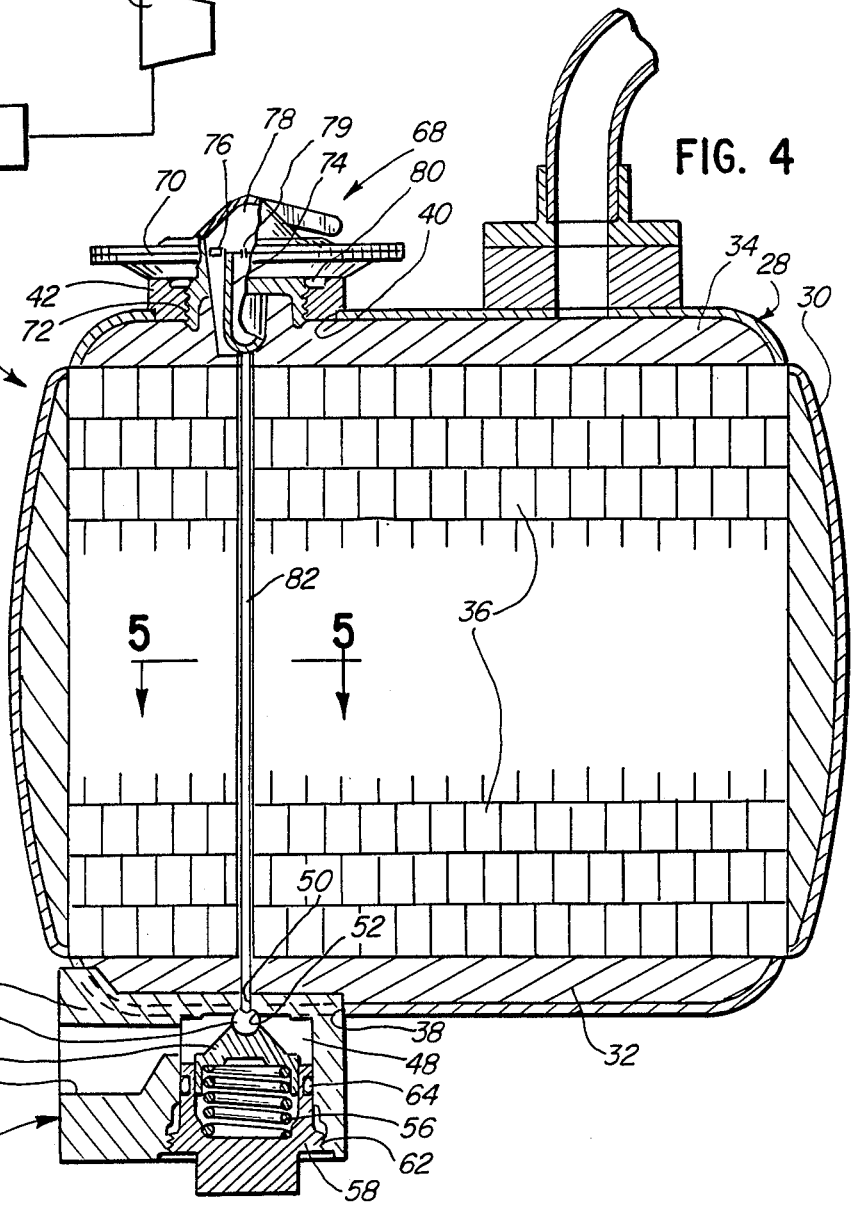
FIG. 4 is a section through the integrated evaporator and thermal expansion valve assembly of the invention.

Referring specifically to FIG. 4, integrated evaporator and thermal expansion valve assembly 26 includes an evaporator, generally designated 28, having a housing 30 defining an inlet header 32 and an outlet header 34. Heat exchanger core means 36 of the plate/fin type are mounted within housing 30 defining flow passage means between inlet header 32 and outlet header 34 as described in greater detail hereinafter. An opening 38 is provided in evaporator housing 30 to inlet header 32, and an opening 40 is provided in evaporator housing 30 to outlet header 34. A mounting boss 42 is secured, as by welding, in opening 40 so as to be integral with housing 30.

Valve means embodied in a refrigerant inlet and valve assembly, generally designated 43, are mounted on housing 30 in communication with inlet header 32 for controlling the flow of refrigerant to evaporator 28 of the refrigeration system. More particularly, a valve housing or mounting block 44 is mounted within housing opening 38, as by welding, so as to be integral with the housing. The mounting block includes a refrigerant inlet 46 communicating with a valve chamber 48. A flow passage 50 communicates valve chamber 48 with inlet header 32. A valve seat 52 surrounds flow passage 50. A valve member 54 is provided for movement toward and away from valve seat 52. A superheat spring 56 is sandwiched between an adjustable spring housing 58 and a spring plunger 60. Spring housing 58 is threaded into mounting block 44, as at 62, for adjusting the spring force. Spring plunger 60 engages valve member 54 for biasing the valve member toward valve seat 52. "Superheat adjustment" is achieved by changing the preload on superheat spring 56 simply by turning spring housing 58 in an adjustment screw manner. An O-ring packing 64 provides a seal between spring housing 58 and mounting block 44.

In essence, superheat spring 56, spring housing 58, spring plunger 60 and O-ring seal 64 comprise a subassembly which is replaceable, facilitates alignment and allows external dynamic adjustment of the superheat with the integrated system of the invention installed in a vapor cycle cooling system. The overall refrigerant inlet and valve assembly 43 meters the flow of refrigerant through evaporator 28 and provides the necessary pressure drop required to achieve a phase change in the refrigerant from liquid to a two-phase cold mixture.

Pressure and temperature responsive means, generally designated 68, are mounted on evaporator housing 30 in communication with outlet header 34 for responding to the superheat temperature in the outlet header for opening valve 54 when the superheat temperature increases and for responding to the pressure in the refrigeration system for closing valve 54 when the pressure increases to offset a portion of the effect of the temperature responsive means on the valve.

More particularly, pressure and temperature responsive means 68 include a casing 70 threaded, as at 72, into mounting boss 42 which is fixed within opening 40 to outlet header 34. Therefore, the entire assembly, as described hereinafter, is readily removable. A sensing bulb 74 is secured to and movable with a steel diaphragm 76 which forms a pressurized chamber 78 beneath the top of casing 70. The sensing bulb is vented, as at 79, to the pressurized cavity. Sensing fluid is injected into the pressurized cavity, and the cavity then is hermetically sealed. Since the sensing bulb and pressurized cavity can communicate through the vent, the sensing fluid also flows into the sensing bulb. The entire sensing bulb assembly, including casing 70, sensing bulb 74 in conjunction with pressurized cavity 78 is threaded into mounting boss 42 at the evaporator outlet header 34 and is sealed by an O-ring packing 80.

Coupling means, in the form of a push rod 82, extend through evaporator housing 30 between inlet header 32 and outlet header 34 generally for operatively connecting pressure and temperature responsive means 68 to the valve means to move the valve means as a function of the responses of the pressure and temperature responsive means. Specifically, push rod 82 is disposed between and operatively interconnects sensing bulb 74 and valve member 54. The rod functions to transmit force from sensing bulb 74 to modulate the position of valve 54.

Figure 5:
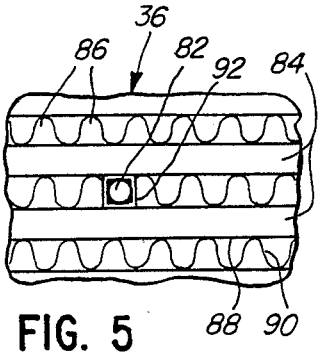
FIG. 5 is a fragmented section taken generally along line 5—5 of FIG. 4.

Referring to FIG. 5 in conjunction with FIG. 4, heat exchanger core 36 in evaporator housing 30 includes coolant passages 84 and refrigerant passages 86. The refrigerant passages are formed by a plate 88 and corrugated fin 90 construction. Push rod 82 extends through a refrigerant passage 86 aligned with sensing bulb 74 and valve member 54. A surrounding enclosure tube 92 (shown of square configuration) may be provided as a guide for push rod 82. The rod may be fabricated of a material the same as that of the heat exchanger core to maintain a given superheat spring setting throughout the operating temperature range of the evaporator. Alternatively, the rod may be of a material with a thermal coefficient of expansion different from that of the heat exchanger core to automatically "trim" the spring setting as the evaporator temperature varies. The spacing between rod 82 and enclosure tube 92 may not necessarily be sealed. The ratio of the length of the rod to the cross-sectional area of this spacing is large, and since the pressure drop across the heat exchanger core is small, leakage through this spacing would be negligible.

In operation, the valve opening between valve member 54 and valve seat 52 and, as a result, the refrigerant flow rate are governed by a force balance between the refrigerant in pressurized chamber 78 acting upon the valve member and the sum of the force of superheat spring 56 plus the pressure of the refrigerant in outlet header 34 acting on the underside of diaphragm 76 and acting to close the valve. Liquid refrigerant from the vapor cycle cooling system condenser enters the inlet and valve assembly 43 and expands through valve passage 50 filling evaporator inlet header 32 with a cold, two-phase mixture of refrigerant. Heat is transferred to this mixture from the coolant in passages 84 as the refrigerant flows through the heat exchanger core. In this process, the refrigerant boils, resulting in a change in phase from the two-phase mixture in inlet header 32 to all superheated gas at outlet header 34.

Since sensing bulb 74 is located directly in outlet header 34, the temperature of the sensing bulb will be equal to the evaporator outlet temperature. Due to the thermal dynamic properties of the sensing fluid, a known relationship between the fluid temperature and pressure exists within pressurized chamber 78. As the sensing fluid temperature varies due to changes in cooling load, the pressure inside the sensing bulb also changes. This change in pressure upsets the force balance. The force balance, and equilibrium, are reestablished when the push rod 82 and valve member 54 move to a new position where the spring force/deflection characteristic again balances with the new refrigerant pressures. Location of the sensing bulb directly in the outlet header also exposes the lower side of diaphragm 76 to outlet header pressure at the same point as bulb temperature is sensed, thereby eliminating the need for an external equalizer line.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a refrigeration system, an integrated evaporator and thermal expansion valve assembly, comprising:

evaporator means including a housing surrounding a heat exchanger core means and defining inlet header means within the housing at one side thereof and outlet header means within the housing at another side thereof;

valve means mounted on the housing in communication with the inlet header means for controlling the flow of refrigerant to the evaporator of the refrigeration system;

pressure and temperature responsive means mounted on the housing with a sensing member directly in the outlet header means for responding to the superheat temperature in the outlet header means of the evaporator for opening the valve means when the superheat temperature increases and for responding to the pressure in the refrigeration system for closing the valve means when the pressure increases to offset a portion of the effect of the temperature responsive means on the valve means; and coupling means extending through the heat exchanger core means between the inlet header means at said one side of the evaporator housing and the outlet header means at said other side of the housing for operatively interconnecting the pressure and temperature responsive means to the valve means to move the valve means as a function of said responses of the pressure and temperature responsive means.

2. In a refrigeration system as set forth in claim 1, wherein the heat exchanger core means is of a plate/fin type and said coupling means extend through the plate/fin structure.

3. In a refrigerant system as set forth in claim 2, wherein said coupling means comprises a push rod within a surrounding enclosure tube.

4. In a refrigeration system as set forth in claim 1, wherein said valve means include a valve member movable toward and away from a valve seat, said pressure and temperature responsive means include a sensing bulb, and said coupling means operatively interconnects the sensing bulb and the valve member.

5. In a refrigeration system as set forth in claim 4, wherein said sensing bulb is secured to a diaphragm of a pressurized chamber in the pressure and temperature responsive means.

6. In a refrigeration system as set forth in claim 5, wherein the sensing bulb and diaphragm form part of a unitary sensing bulb assembly mounted on the evaporator housing in communication with the outlet header means.

7. In a refrigeration system as set forth in claim 6, wherein the evaporator housing has an opening to the outlet header means surrounded by a mounting boss integral with the evaporator housing, and said unitary sensing bulb assembly is threaded into the mounting boss.

8. In a refrigeration system as set forth in claim 1, wherein the valve means form part of a unitary refrigerant inlet and valve assembly mounted on the evaporator housing in communication with the inlet header means.

9. In a refrigeration system as set forth in claim 8, wherein the evaporator housing has an opening to the inlet header means, and said unitary refrigerant inlet and valve assembly is mounted in said opening integral with the evaporator housing.

10. In a refrigeration system as set forth in claim 1, wherein said valve means include a valve seat, a valve member movable toward and away from the valve seat and a superheat spring for biasing the valve member toward the valve seat, said coupling means being connected to the valve member for moving the valve member in a direction coincident with the spring force direction.

11. In a refrigeration system as set forth in claim 1, wherein said coupling means include a push rod through the heat exchanger core.

12. In a refrigeration system as set forth in claim 11, wherein said push rod is fabricated of a material the same as that of the heat exchanger core.

13. In a refrigeration system as set forth in claim 11, wherein said push rod is fabricated of a material having a different coefficient of expansion than that of the heat exchanger core.

14. In a refrigeration system as set forth in claim 11, wherein said push rod is disposed within a surrounding enclosure tube extending through the heat exchanger core.

15. In a refrigeration system, an integrated evaporator and thermal expansion valve assembly, comprising:

evaporator means including a housing surrounding a heat exchanger core means and defining inlet header means within the housing at one side thereof and outlet header means within the housing at another side thereof; with an opening in the housing to the inlet header means and an opening in the housing to the outlet header means;

a unitary refrigerant inlet and valve assembly mounted on the evaporator housing in the opening to the inlet header means for controlling the flow of refrigerant to the evaporator of the refrigeration system;

pressure and temperature responsive means mounted in the opening in the housing to the outlet header means with a sensing member directly in the outlet header means for responding to the superheat temperature increases and for responding to the pressure in the refrigeration system for closing the valve means when the pressure increases to offset a portion of the effect of the temperature responsive means on the valve means; and coupling means extending through the heat exchanger core means between the inlet header means at said one side of the evaporator housing and the outlet header means at said other side of the housing for operatively interconnecting the pressure and temperature responsive means to the valve means to move the valve means as a function of said responses of the pressure and temperture responsive means.

16. In a refrigeration system as set forth in claim 15, wherein said valve means include a valve member movable toward and away from a valve seat, said pressure and temperature responsive means include a sensing bulb, and said coupling means operatively interconnects the sensing bulb and the valve member.

17. In a refrigeration system as set forth in claim 16, wherein said sensing bulb is secured to a diaphragm of a pressurized chamber in the pressure and temperature responsive means.

18. In a refrigeration system as set forth in claim 17, wherein the sensing bulb and diaphragm form part of a unitary sensing bulb assembly mounted on the evaporator housing in communication with the outlet header means.

19. In a refrigeration system as set forth in claim 15, wherein said valve means include a valve seat, a valve member movable toward and away from the valve seat and a superheat spring for biasing the valve member toward the valve seat, said coupling means being connected to the valve member for moving the valve member in a direction coincident with the spring force direction.

20. In a refrigeration system as set forth in claim 15, wherein said coupling means include a push rod extending through the heat exchanger core.

21. In a refrigeration system as set forth in claim 20, wherein said push rod is fabricated of a material the same as that of the heat exchanger core.

22. In a refrigeration system as set forth in claim 20, wherein said push rod is fabricated of a material having a different coefficient of expansion than that of the heat exchanger core.

23. In a refrigeration system as set forth in claim 20, wherein said push rod is disposed within a surrounding enclosure tube extending through the heat exchanger core.

24. In a refrigeration system as set forth in claim 15, wherein said pressure and temperature responsive means include a sensing bulb secured to a diaphragm of a pressurized chamber, the sensing bulb being exposed to the outlet header means, and including vent means communicating between the sensing bulb and the pressurized chamber.

* * * * *